US005634567A

United States Patent [19]

Hekal

[11] Patent Number: 5,634,567

[45] Date of Patent: Jun. 3, 1997

[54] HEAT BONDABLE CONTAINER CLOSURE

[75] Inventor: Ihab Hekal, Stamford, Conn.

[73] Assignee: Polystar Packaging, Inc., Norwalk, Conn.

[21] Appl. No.: 183,826

[22] Filed: Jan. 21, 1994

[51] Int. Cl.[6] ..... B65D 41/00

[52] U.S. Cl. ..... 220/359; 220/254; 220/780; 215/232

[58] Field of Search ..... 215/232, 250, 215/256, 298, 317, 324, 326, 327, 274, 341, 349, 350, 351; 220/254, 265, 268, 270, 276, 214, 359, 306

[56] References Cited

U.S. PATENT DOCUMENTS

| | | | |
|---|---|---|---|
| 3,973,689 | 8/1976 | Sutch | 215/317 |
| 4,094,460 | 6/1978 | Scanga et al. | 215/232 X |
| 4,096,963 | 6/1978 | Rumball | 215/324 X |
| 4,418,834 | 12/1983 | Helms et al. | 215/232 X |
| 4,857,369 | 8/1989 | Dehlenschlaeger et al. | 215/232 X |
| 5,246,134 | 9/1993 | Roth et al. | 215/232 X |

*Primary Examiner*—Allan N. Shoap
*Assistant Examiner*—Nathan Newhouse
*Attorney, Agent, or Firm*—William H. Holt

[57] ABSTRACT

This relates to an end closure for conventional types of containers which may be in the form of glass or plastic jars and bottles or in the form of specially formed metal containers having a folded outwardly projecting annular rim at the top thereof. The end closures are constructed so as to be snapped in place on the containers thus retaining the closures on and keeping the containers closed by a mechanical interlock between the respective closure and container. Further, the end closures have heat-bondable surfaces which when subjected to low temperature heat, such as by heating the rims of the containers or by heating the packaged product within a retort cooker, the heat-bondable surfaces of the end closures will bond to the touching surfaces of the container.

16 Claims, 1 Drawing Sheet

HEAT BONDABLE CONTAINER CLOSURE

This invention relates in general to new and useful improvements in container closures, and more particularly to a container closure, or end closure, especially constructed for bonding to glass and plastic containers.

BACKGROUND OF THE INVENTION

The closures in current use include plastic and metal closures for closing glass jars including baby food, peanuts and all sorts of other foods and non-food products. Some closures are snapped on and off, other closures are twisted on and off and still other closures are snapped on, and twisted off. In almost all cases, these closures are totally removed from the container, to open the container for product removal, except for some tamper bands which have portions that are retained around the neck of the jar or bottle.

The current closure concepts require design and manufacturing sensitivity to removal torques and forces while avoiding contamination under the exterior flange of the closure cap. At the same time, leakage due to discontinuity in the closure or closure gasket and the glass of the container must be avoided. Also, tamper evidence is limited in many cases to a metal button which responds to the loss of vacuum when the closure is opened.

BRIEF DESCRIPTION OF THE INVENTION

This invention most specifically relates to an end closure for a glass jar or bottle, a properly prepared metal can having a curled flange, or a plastic cup or bottle where the material of the closure both mechanically attaches to the container and then is permanently bonded to the container when the container is put through a heat history, usually a retort cooker. While providing a permanent bond to the container, this concept utilizes a peelable disc on the top of the end closure to give the consumer access to the packaged product. Since the peelable disc, usually formed of a laminate of metal foil and plastic, provides a good tamper evidence, tampering would have to involve violations of the closure-to- container interface which is permanently bonded thus causing obvious tampering evidence through destruction of the permanent bond and, thus, the closure.

Bonding to glass or plastic in accordance with this invention is not unique, per se. Mechanical closing of a container is also not unique. However, in accordance with this invention, the end closure is to be mechanically interlocked with the container followed by the creation of a permanent bond between the end closure and the container which bond, as an example, can be accomplished at a relatively low temperature during retorting of the product. This is accomplished by forming the primary portion of the end closure of two materials, an outer structural resin and an inner sealing resin.

DETAILED DESCRIPTION

Figure 1:
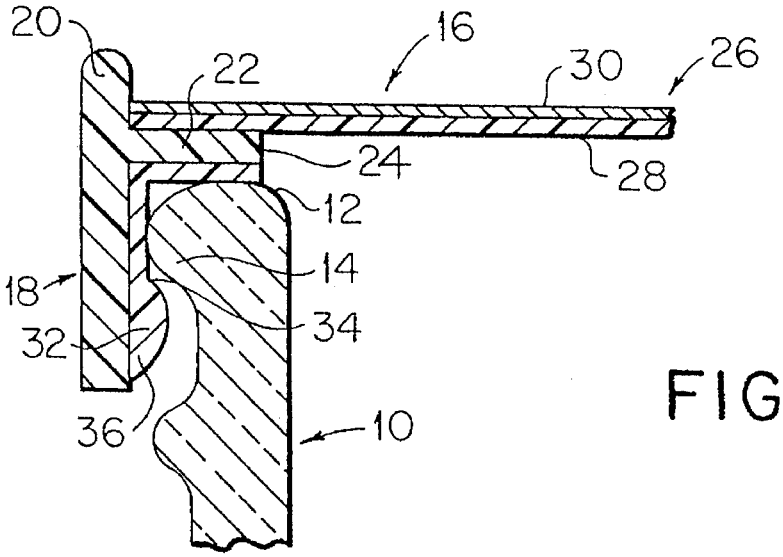
FIG. 1 is a fragmentary sectional view of an upper portion of a container and an end closure formed in accordance with this invention.

Referring now to the drawings in detail, it is to be understood that it is the purpose of this invention to provide an end closure that first has a mechanical connection with a container which holds the end closure in proper position for a later formation of a bonded seal between the end closure and the container even though the container may be formed of glass.

In the drawings there is illustrated a convention type of container generally identified by the numeral 10. The illustrated container is formed of glass and may, for example, be in the form of a baby food jar. The container 10 is provided with an open mouth which includes an end surface 12 with which a seal is normally formed by an end closure. The outer periphery of the rim or upper end of the container 10 is provided with a radially outwardly projection 14 which may vary depending upon the particular type of end closure intended for use with the container 10. For example, the projection 14 may be in the form of a continuous annular projection, the projection 14 may be in the form of a screw thread, or the projection 14 may be in the form of interrupted screw threads or lugs. Normally, the projection 14 forms the sole means for securing an end closure to the container and the seal must be formed between the end surface and the gasket (not shown) of a typical present end closure.

Before going into the details of the end closure which is the subject of this invention, it is pointed out here that while the container 10 has been illustrated as being formed of glass, depending upon the purpose of the container, it may also be formed of plastic. Further, in special cases, the container 10 may be formed of metal having a folded end portion defining the projection 14.

In FIG. 1 there is illustrated one form of end closure formed in accordance with this invention, the end closure being generally identified by the numeral 16. The end closure 16 includes a frame generally identified by the numeral 18. The frame of FIG. 1 is in the form of a peripheral rim 20 which is constructed to have the desired structural strength. Intermediate ends of the rim 20 is an inwardly projecting ledge 22 defining an inner opening 24 through which the product packaged within the container 10 may be dispensed. The opening 24 is closed by a panel 26 which is peelably bonded to and seated on ledge 22. The panel 26 is preferably of a laminated construction and may include a lower plastic panel 28 and an upper panel 30 which may be formed of plastic or metal foil. The panel 26 may be heat-bonded to the ledge 22 in a known manner wherein it may be readily removed from the ledge 22 in a peeling action.

The rim member 20 carries a bonding member 32. The bonding member 32 is provided with an inner surface 34 which, when heated to low temperatures such as those involved with retorting, will bond to the container 10.

It will be seen that the lower portion of the bonding member 32 is in the form of an inwardly directed rounded projection 36. This projection is of a size so as to be snapped over the projection, or projections, 14 of the container 10.

Thus, after the product to be packaged is placed within the container 10, the end closure 16 is applied in a downward snapping action, and is held in place, preferably seated on the end surface 12. Thereafter, in a suitable heating operation, such as by retorting, the bondable surface 36 is activated so as to directly bond to the container 10 shown at both along the end surface 12 and the projection, or projections, 14 of the container 10.

Although retorting has been specifically mentioned, depending upon the material of the container 10, it is also feasible to heat the end portion of the container 10 immediately before the application of the end closure 16 so that the desired bonding effect will take place.

Although many materials are available, it is preferred that the rim member 20 and the integral ledge 22 thereof be formed of a polyolefin or other moldable polymers such as PET and nylon. On the other hand, the bondable member 32 is preferably formed of a surface of BINEL® coating material (supplied by DuPont) on ethylene acrylic acid copolymer or regular ethylene.

The end closure 16 is preferably formed by a multiple step, injection molding operation.

Figure 2:
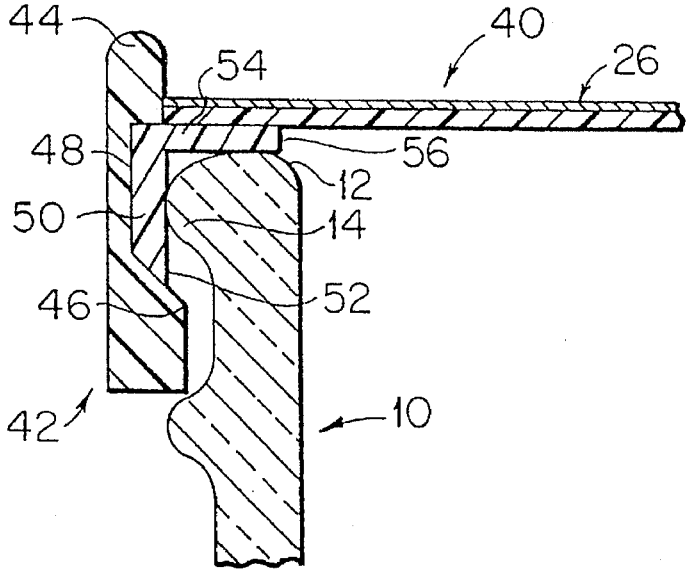
FIG. 2 is a similar sectional view through a container similar to that of FIG. 1 and shows a modified form of end closure.

In FIG. 2 there is illustrated the same general type of container 10 closed and sealed by way of a second end closure generally identified by the numeral 40. End closure 40 is intended to be snapped into a container-closing position followed by heat bonding to the container.

The end closure 40 includes a frame member 42 in the form of a peripheral rim member 44 having a radially inwardly directed lower projection 46. The rim member 44 is internally recessed, as at 48, and has seated therein a bonding member 50 which includes a bonding surface 52.

The bonding member 50 is generally angular in cross section and includes an upper internally directed ledge 54 which replaces the ledge 22 and which defines an inner product dispensing opening 56. The ledge 54 has seated thereon an outer peripheral portion of the panel 26 which is peelably bonded thereto. The panel 26 will be of the same construction as that specifically described with respect to FIG. 1.

It will be seen that when the end closure 40 is snapped onto the container 10, the inner projection 46 will mechanically lock the end closure 40 onto the container 10 in the position illustrated in FIG. 2. Thereafter, a heating operation will cause the bonding surface 52 to form a bond with the touched adjacent portions of the container 10.

The same materials of construction will be utilized in the end closure 40 as those described with respect to the end closure 16.

Figure 3:
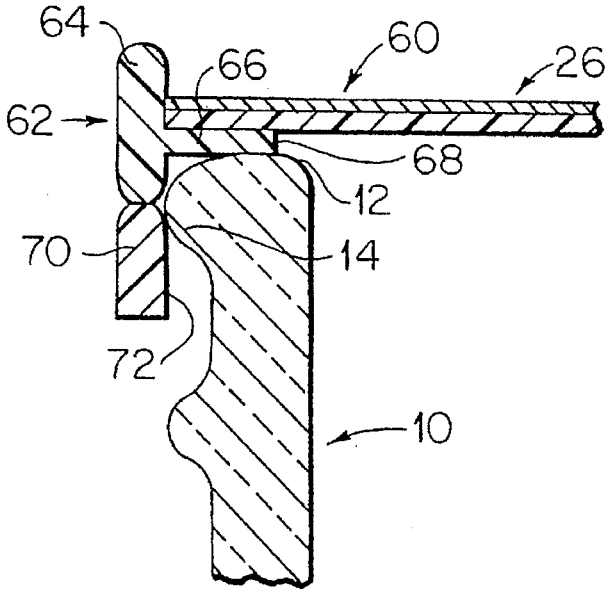
FIG. 3 is a fragmentary sectional view also similar to FIG. 1 showing a container similar to that of FIG. 1 but having a modified form of end closure.

Referring now to FIG. 3, it will be seen that there is illustrated a third form of end closure generally identified by the numeral 60. The end closure 60 is illustrated once again in association with a container such as the container 10.

The end closure 60 includes a somewhat rigid frame 62 which includes an outer peripheral rim member 64. The rim member 64, in turn, has an inwardly directed ledge 66 defining a product dispensing opening 68. The ledge 66 has seated thereon and bonded thereto a panel generally identified by the numeral 26 which corresponds to the previously described panel.

The rim member 64 has bonded to a lower edge thereof a bonding member generally identified by the numeral 70 which is in the form an elongated sleeve having an inner bonding surface 72. The frame 62 is so proportioned wherein the bonding member 70 will be distorted over the projection or projections 14 and have a mechanical interlock therewith while being in tight contact therewith. Thereafter, heating of the bondable surface 72 will result in the forming of a bond with the projection 14.

The various components of the end closure 60 will be formed substantially of the same materials as those of the end closure 16 with the panel 26 being injection molded relative to the ledge 66 so as to have a peelable bond therewith while the bonding member 70 will be injection molded and thereby bonded to the lower edge of the rim member 64.

Although no means for facilitating removal of the panel 26 has been illustrated, it is to be understood that conventionally the panel 26 will be provided with a suitable means for facilitating the peeling thereof from its associated ledge with such means including a pull tab (not shown).

It will be readily apparent that in each of the several forms of end closures, access to the product within the container 10 can be had by either peeling back a portion of the panel 26 or by interrupting the bond between the end closure and the container, both of which would be readily observable. Thus the end closures are provided with automatic tamper indicating means.

Although only several preferred embodiments of end closures formed in accordance with this invention have been specifically illustrated and described herein, it is to be understood that minor variations may be made in the end closure construction without departing from the spirit and scope of the invention as defined by the appended claims.

I claim:

1. An end closure for closing containers having radially outwardly directed closure retaining projections, said end closure comprising, before attachment to a container, an outer rim member having an inwardly directed ledge defining an inner product dispensing opening, a panel seated on said ledge and closing said product dispensing opening, a bonding member carried by said rim member and having a surface heat bondable to a container, and one of said rim member and said bonding member being positioned for snap engagement with a container closure retaining projection for initially retaining said end closure on a container.

2. An end closure according to claim 1 wherein said panel is peelably bonded to said ledge for opening a container closed by said end closure.

3. An end closure according to claim 1 wherein said ledge is integral with said rim member.

4. An end closure according to claim 1 wherein said ledge is part of said bonding member.

5. An end closure according to claim 1 wherein said bonding member is that member engageable with a container closure retaining projection.

6. An end closure according to claim 1 wherein said bonding member is that member engageable with a container closure retaining projection and has a lower radially inwardly directed projection.

7. An end closure according to claim 1 wherein said bonding member is that member engageable with a container closure retaining projection and is in the form of a lower continuation of said rim member.

8. An end closure according to claim 1 wherein said bonding member is that member engageable with a container closure retaining projection and is in the form of a lower sleeve-like continuation of said rim member.

9. An end closure according to claim 1 wherein said rim member is that member engageable with a container closure retaining projection.

10. An end closure according to claim 1 wherein said rim member is that member engageable with a container closure retaining projection and has a lower radially inwardly directed projection.

11. An end closure according to claim 1 wherein said rim member is that member engageable with a container closure retaining projection and has a lower radially inwardly directed projection disposed below and inwardly of said bonding member.

12. An end closure according to claim 1 wherein said rim member and said bonding member are both comprised of plastic.

13. An end closure according to claim 12 wherein said rim member and said bonding member are double injection molded together.

14. A closed container unit comprising a jar-like container, said container having a rim portion formed with at least one projection for receiving a closure, an end closure snapped on said rim portion in interlocked relation with said projection for initially attaching said end closure to said container, and then a heat bond being formed between said end closure and said projection.

15. A closed container unit according to claim 14 wherein said end closure comprises a peripheral frame including an outer rim member having an inwardly directed ledge, said ledge defining an inner product dispensing opening, a panel seated on said ledge and temporarily closing said product dispensing opening, and a separate bonding member carded by said rim member and forming said heat bond.

16. A closed container unit according to claim 15 wherein said rim member and said bonding member are injection molded together.

* * * * *